US011332898B2

(12) United States Patent
Kramer et al.

(10) Patent No.: US 11,332,898 B2
(45) **Date of Patent: *May 17, 2022**

(54) MOBILE ACCESS CONTROL SYSTEM

(71) Applicant: MOBILE GATE SECURITY A/S, Skanderborg (DK)

(72) Inventors: Lars Kramer, Aarhus C (DK); Thomas Grumstrup, Ikast (DK)

(73) Assignee: Mobile Gate Security A/S, Skanderborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/738,929

(22) Filed: Jan. 9, 2020

(65) Prior Publication Data

US 2020/0141075 A1 May 7, 2020

Related U.S. Application Data

(63) Continuation of application No. 15/761,339, filed as application No. PCT/EP2016/071956 on Sep. 16, 2016, now Pat. No. 10,570,577.

(30) Foreign Application Priority Data

Sep. 18, 2015 (EP) ..... 15185844

(51) Int. Cl.
*E01F 13/04* (2006.01)
*E01F 13/08* (2006.01)

(52) U.S. Cl.
CPC ..... *E01F 13/048* (2013.01); *E01F 13/08* (2013.01)

(58) Field of Classification Search
CPC . E01F 13/00; E01F 13/02; E01F 13/04; E01F 13/048
See application file for complete search history.

(56) References Cited

U.S. PATENT DOCUMENTS 488,755 A 12/1892 Della
731,716 A 6/1903 Slater
(Continued)

FOREIGN PATENT DOCUMENTS

CN 206220023 6/2017
DE 20101611 U1 4/2001
(Continued)

*Primary Examiner* — Gary S Hartmann
(74) *Attorney, Agent, or Firm* — Dykema Gossett PLLC

(57) ABSTRACT

An access control system is provided for controlling access to an area secured by perimeter protection defining a secure perimeter. The access control system comprises a portable container configured to be stored, transported and installed repeatedly as a closed container. The portable container is further configured to be operated repeatedly as an open container and closed container with a permanent barrier section constituted by the portable container and configured to secure a perimeter. At least one operational barrier section is configured to be operational in an open state to allow access through the secure perimeter and in a closed state to block access through the secure perimeter. The operational barrier section is configured to be fully contained within the closed container when not installed is also configured to operate outside of the portable container in either open or closed state and to change between open and closed state.

35 Claims, 10 Drawing Sheets

(56) References Cited

U.S. PATENT DOCUMENTS

| | | | | |
|---|---|---|---|---|
| 1,639,866 | A | 8/1927 | Szuch | |
| 1,698,410 | A | 10/1927 | McFarland | |
| 4,844,420 | A * | 7/1989 | Oster | B65H 75/38 256/1 |
| 6,733,204 | B1 | 5/2004 | Paniccia | |
| 7,207,370 | B2 * | 4/2007 | Snyder | E01F 13/028 160/23.1 |
| 7,217,061 | B2 * | 5/2007 | Stratton | E01F 7/00 160/24 |
| 7,326,355 | B2 | 2/2008 | Graetz | |
| 7,762,025 | B2 | 7/2010 | Slagel | |
| 7,802,521 | B2 | 9/2010 | Gunes | |
| 7,823,338 | B2 | 11/2010 | Slagel et al. | |
| 8,176,684 | B2 | 5/2012 | Marchetto | |
| 8,181,689 | B2 | 5/2012 | Gill | |
| 10,570,577 | B2 * | 2/2020 | Kramer | E01F 13/048 |
| 2004/0206015 | A1 | 10/2004 | Greenboim | |
| 2008/0098924 | A1 * | 5/2008 | Han | B61B 1/02 104/31 |
| 2012/0030665 | A1 | 12/2012 | Hall et al. | |
| 2014/0259930 | A1 | 9/2014 | Gilliam | |
| 2021/0054586 | A1 * | 2/2021 | Wiegel | E06B 9/80 |

FOREIGN PATENT DOCUMENTS

| | | | |
|---|---|---|---|
| GB | 2511787 | A * | 9/2014 |
| WO | 2014184537 | A1 | 11/2014 |

* cited by examiner

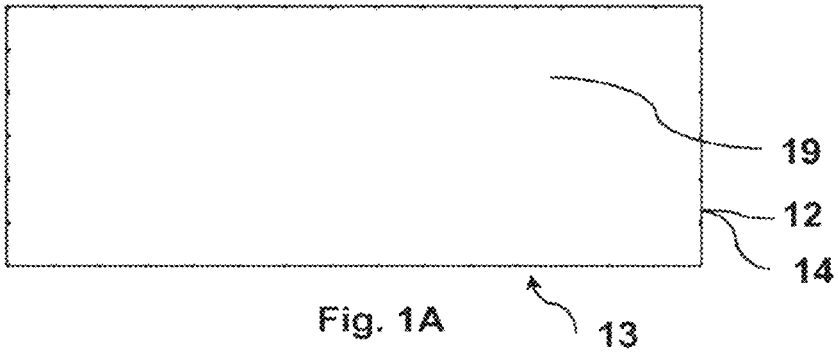
Fig. 1A
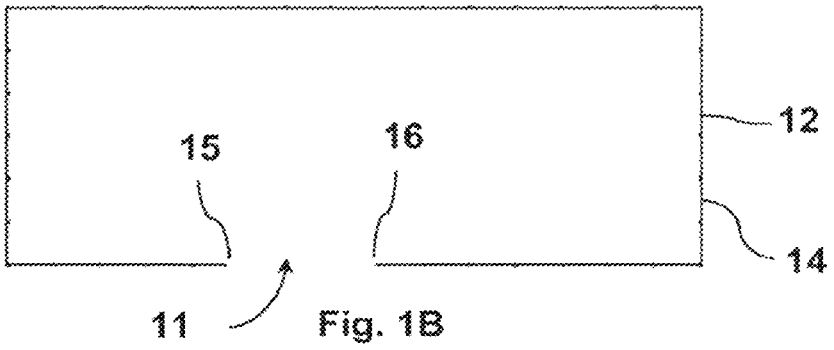
Fig. 1B
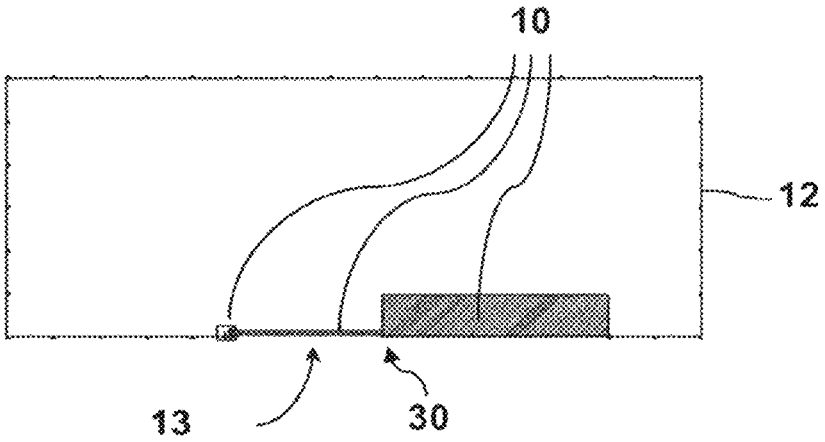
Fig. 1C
Fig. 1

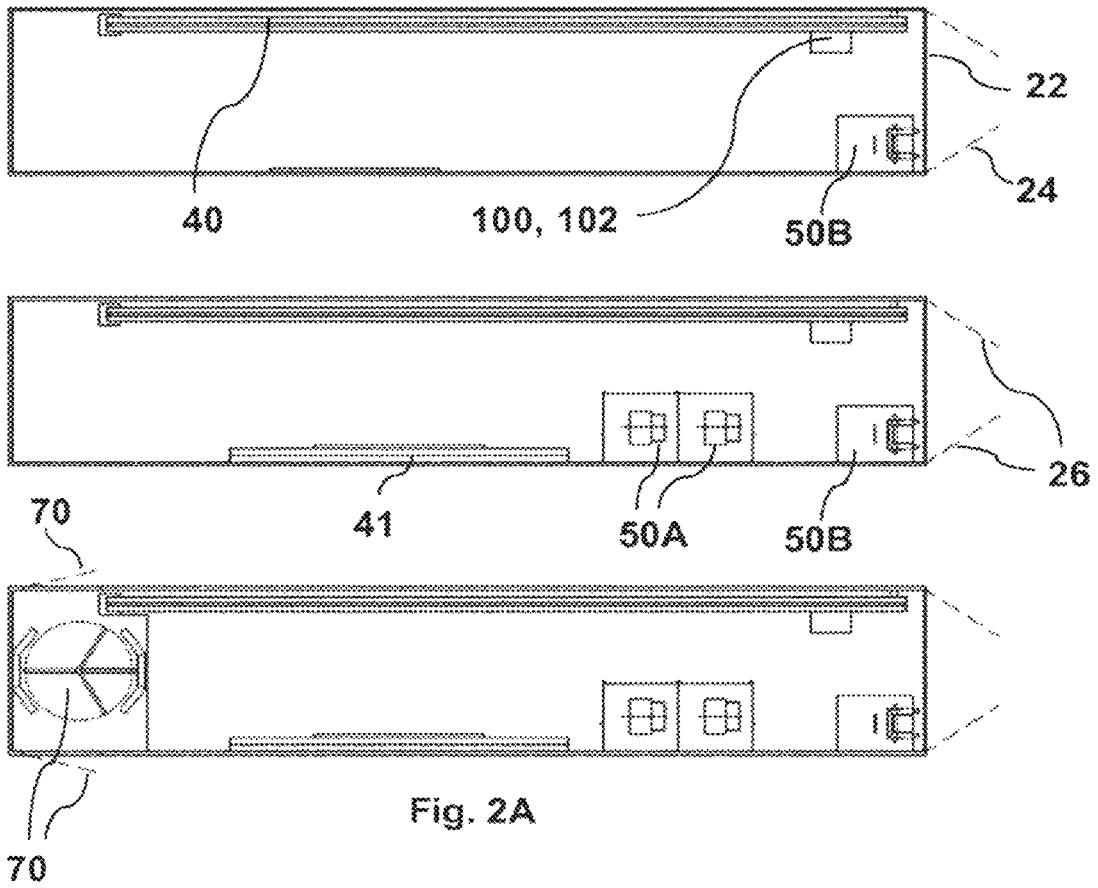
Fig. 2A
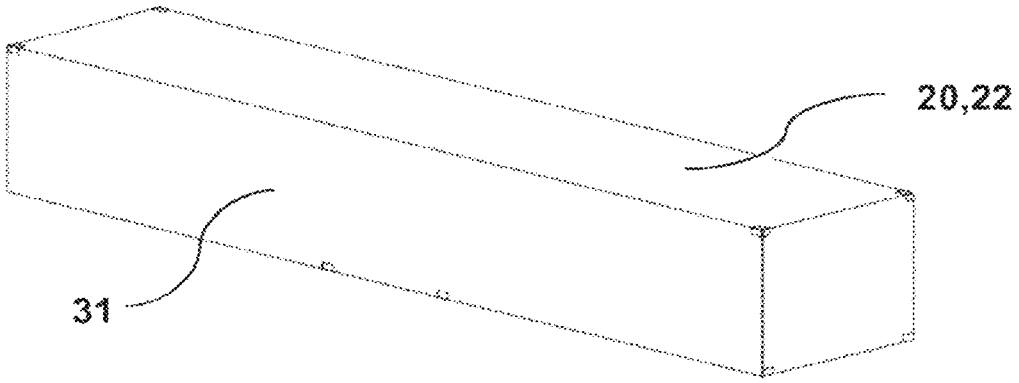
Fig. 2B
Fig. 2

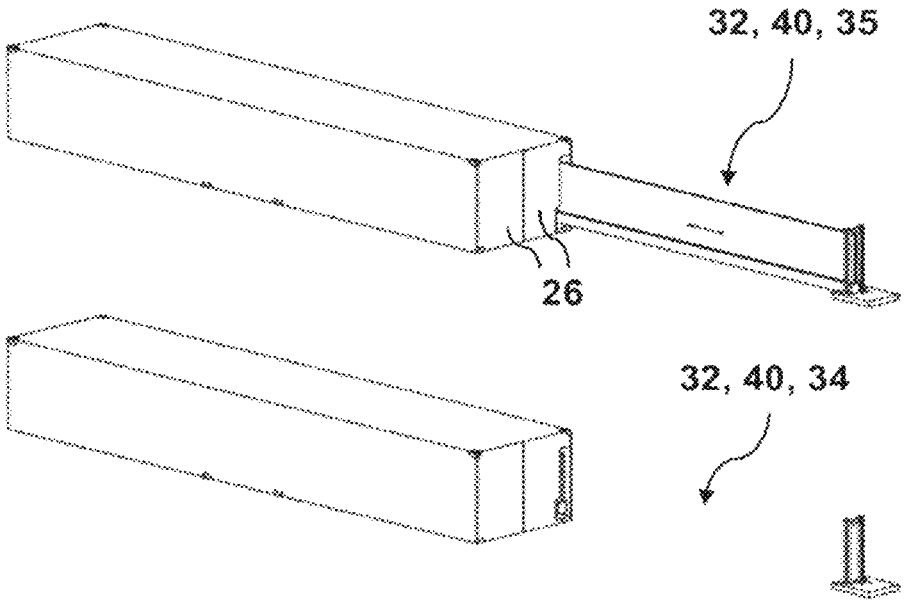
Fig. 3A
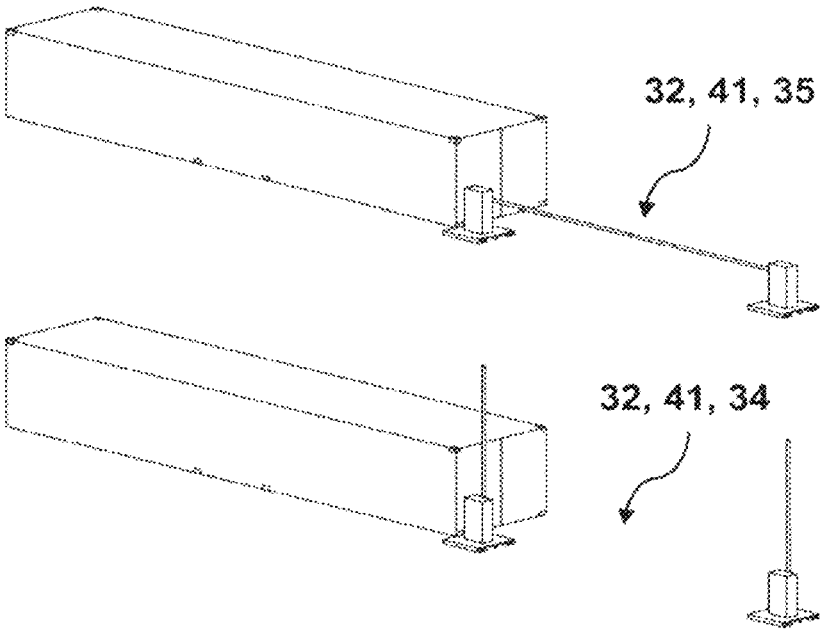
Fig. 3B
Fig. 3

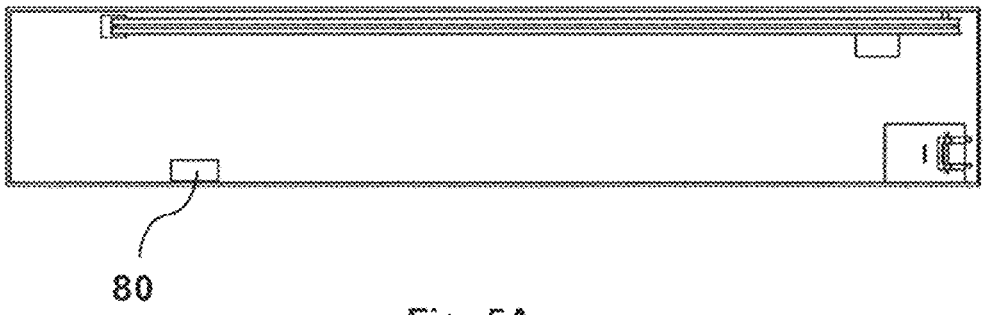
Fig. 5A
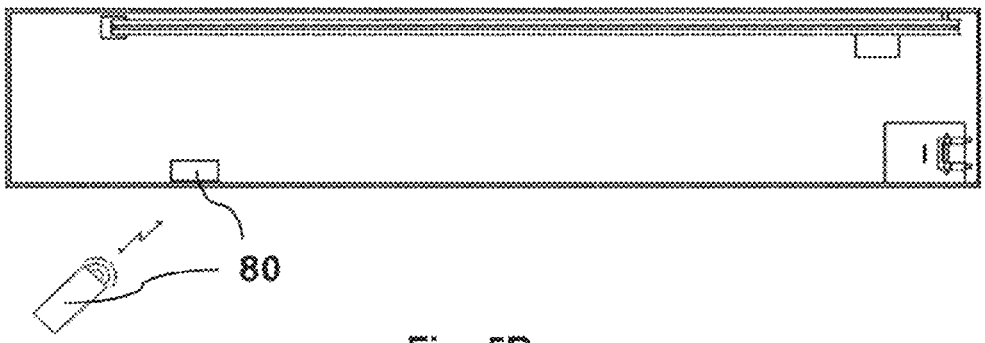
Fig. 5B
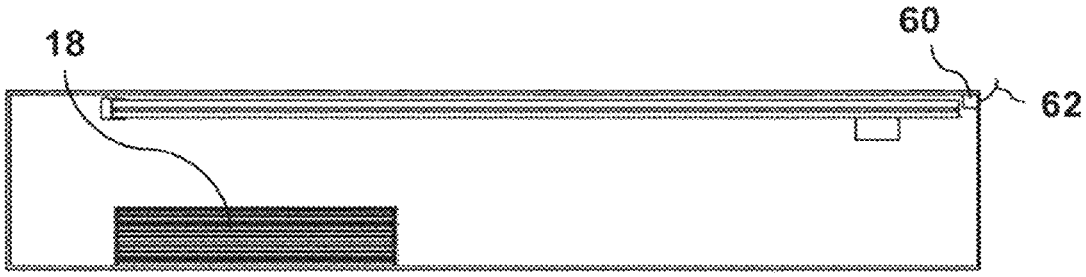
Fig. 5C
Fig. 5

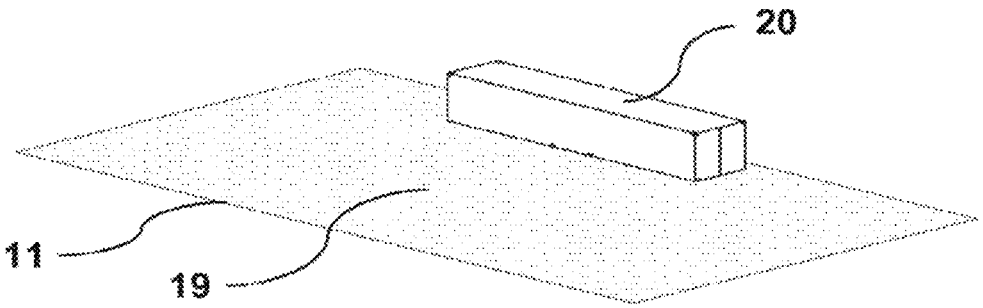
Fig. 6A
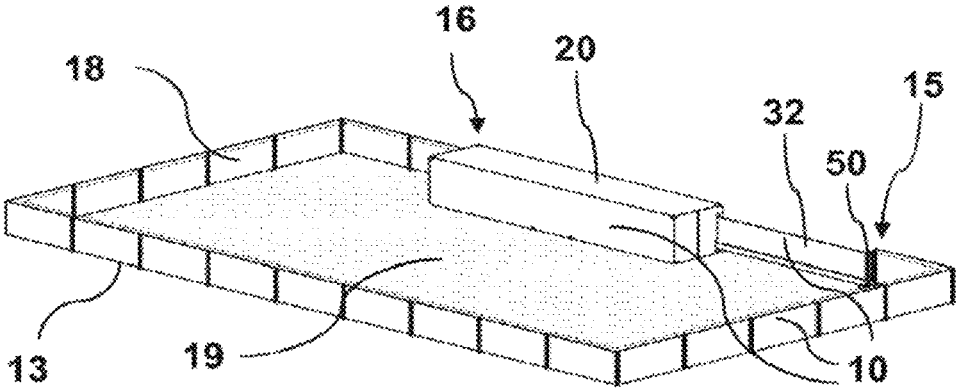
Fig. 6B
Fig. 6

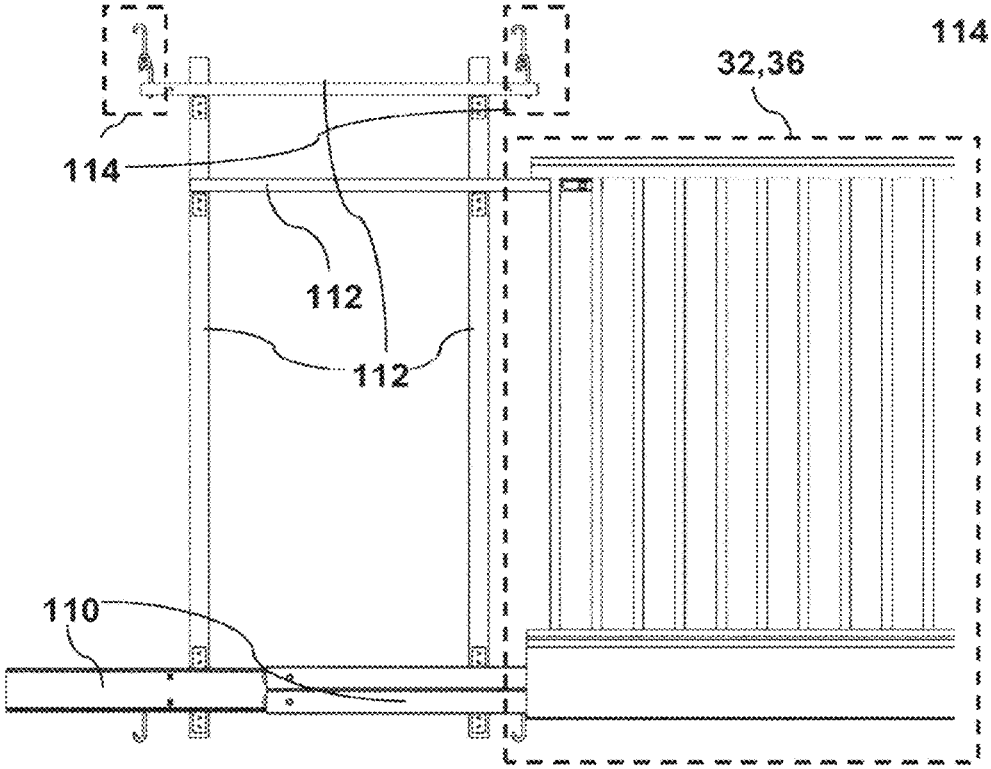
Fig. 8A
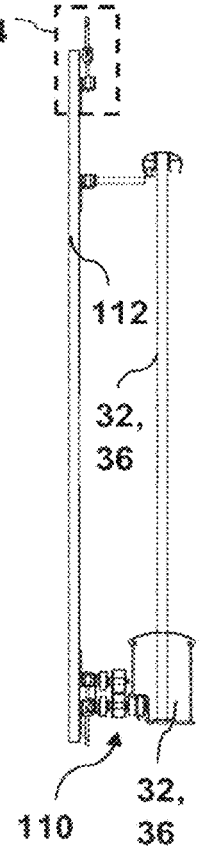
Fig. 8B
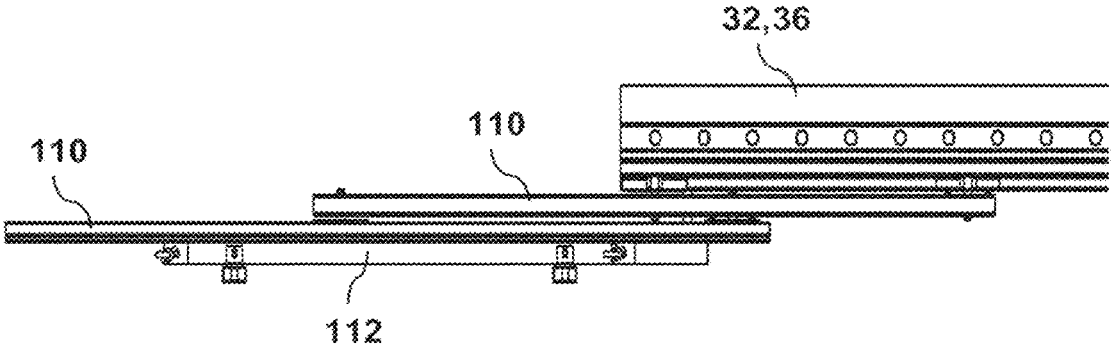
Fig. 8C
Fig. 8

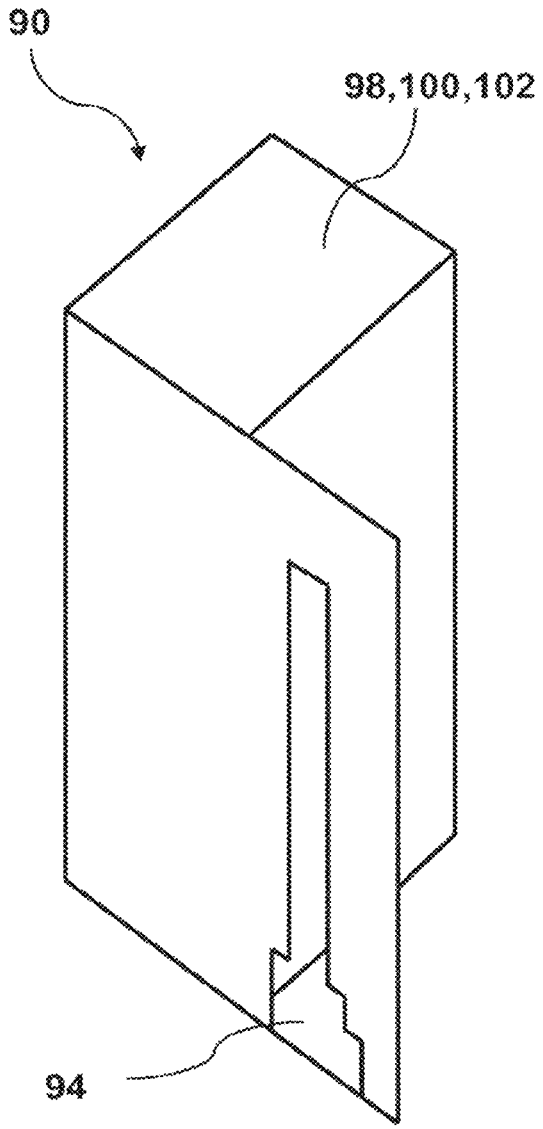
Fig. 9A
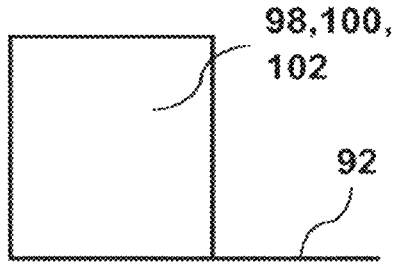
Fig. 9B
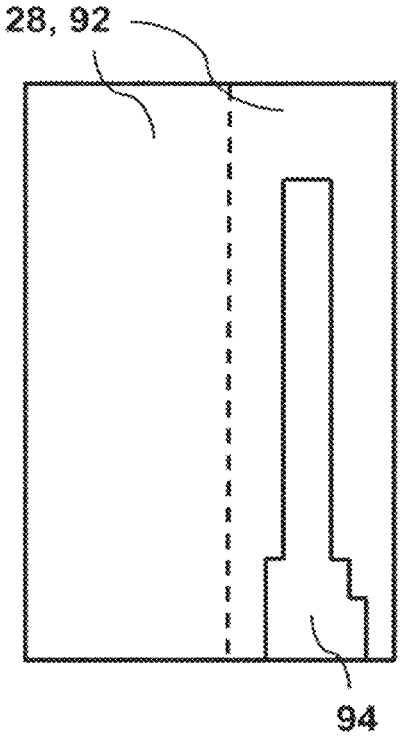
Fig. 9C
Fig. 9

MOBILE ACCESS CONTROL SYSTEM

CROSS REFERENCE TO RELATED APPLICATIONS

This application is a continuation of application Ser. No. 15/761,339, filed 19 Mar. 2018, which is the National Stage of International Application No. PCT/EP2016/071956, filed 16 Sep. 2016, which claims priority to European Application No. 15185844.6, filed 18 Sep. 2015.

FIELD OF THE INVENTION

The present invention relates to an access control system for controlling access to an area secured by a perimeter protection defining a secure perimeter. The access control system comprises a portable container configured to be stored, transported and installed repeatedly as a closed container. The portable container is further configured to be operated repeatedly as an open container and closed container with a permanent barrier section constituted by the portable container itself and configured to secure a perimeter. Furthermore the access control system comprises at least one operational barrier section configured to be operational in an open state to allow access through the secure perimeter to the area and in a closed state to block access through the secure perimeter to the area. The operational barrier section is configured to be fully contained within the closed container when not installed. Additionally, the operational barrier section is configured to operate outside of the portable container in either open state or closed state and to change between open state and closed state.

BACKGROUND OF THE INVENTION

The background for the invention is to establish an access control system for vehicles or/and people, which is quick to install, move, dismantle and has low installation cost. Access control systems for secure perimeters secured by perimeter protection are established with fixed installation and concrete foundations requiring tedious construction work and costs both for installation of the system but also when demounting the system.

A container with an extractable gate as a barrier member has been disclosed in WO 2014/184537. However, the disclosure suggests a grill-gate type of barrier being extractable from a container by a motor as the state of the art, leaving a number of operational and structural issues unattended.

OBJECT OF THE INVENTION

It is thus an object of the invention to provide an access control system comprising a portable container without the aforementioned drawbacks. Another object of the invention is to provide a portable system which is mounted in a normal standard container for easy shipment and storage.

DESCRIPTION OF THE INVENTION

The aforementioned aspects of the invention may be achieved by an access control system for controlling access to an area secured by perimeter protection. The access control system comprises a portable container configured to be stored, transported and installed repeatedly as a closed container. The portable container is further configured to be operated repeatedly as an open container and closed container with a permanent barrier section constituted by the portable container itself and configured to secure a perimeter. Furthermore the access control system comprises at least one operational barrier section configured to be operational in an open state to allow access through the secure perimeter to the area and in a closed state to block access through the secure perimeter to the area. The operational barrier section is configured to be fully contained within the closed container when not installed. Additionally, the operational barrier section is configured to operate outside of the portable container in either open state or closed state and to change between open state and closed state.

An effect of this embodiment is to provide security barrier section with a portable access system. This is advantageous in regard to providing a barrier section to a secured perimeter to establish an access way secured by operational barrier. By secured perimeter is meant a perimeter secured by perimeter protection or perimeter barrier, which can be either an existing perimeter protection or a temporarily established perimeter protection. The advantages of the embodiment is thus to up-hold the secured perimeter while providing an access way.

The effect of access control system contained in and comprised of a portable container is that the system is compressed to a single portable container when not operated. This is advantageous in regard to storage and shipment of complete systems, as storage, handling and transport of the containers can be done by ordinary logistic means.

A further effect of a portable access control system is that all parts of the system are moveable. The advantage of this is that no concrete foundation is required reducing installation time and expenses. This should be seen in comparison to prior art where fixed installation on a concrete foundation is normal for this kind of installation, and thus demands new concrete foundations if an access control system has to be installed, moved or replaced. Omission of concrete foundations reduces the installation time due to the construction time for digging holes for the concrete foundations and drying time for the concrete is eliminated.

Additional effects are that the access control system is a plug-and-play system. This is advantageous not only in regard to installation time and expenses due to constructions as already emphasized but also in view of manpower and skilled workers to be involved in installation of the system covering amongst other construction workers due to omission of fixed constructions and other skilled persons for system integration with existing power systems as the system is placed in a container with plug and play power connectors. This also provides for a short timeframe wherein installation and a fully operational system are achieved.

The portable container may be configured as a closed container suitable for transport. This may include that parts stored or contained within the container are fixed or mounted to the interior of the container. The portable container may be configured as an open container suitable for operation in a stationary location. The open container may be provided by doors that can open and may include slits configured to allow passage of the operational barriers during operation. Such opening may be covered by a door or configured with a cover or a seal to protect the interior of the container either in a secure fashion and/or as weather seal.

In one embodiment the permanent barrier section may be the wall of the portable container. And operational barrier section may be in the form of a fence, a gate, a cantilever gate, a boom or the like.

In some settings the operational barrier may be adapted to control access of vehicles to the perimeter. In other cases, the operational barrier may be adapted to control access of personnel to a perimeter.

In an embodiment the access control system comprises at least two operational barrier sections wherein at least one operational barrier section has a high level of perimeter security and at least one other operational barrier section has a low level of perimeter security when in closed state. The high level of perimeter security may be represented in form of a strong fence or a gate as the operational barrier. And the low level of perimeter security may be operational barriers like a bar or a boom-like construction.

A further embodiment of the access control system comprising the at least two operational barrier sections includes at least one operational barrier section which has a fast change from closed state to open state, from open state to closed state and between open and closed states. Additionally the access control system includes at least one other operational barrier section which has a slow change from closed state to open state, from open state to closed state and between open and closed states. The fast change operational barrier may be a bar or a boom-like construction while the operational barrier displaying slow change may be a strong fence or a gate.

The effects are that different levels of security can be upheld using one access control system and furthermore that the operation time of the operational barrier sections can be adjusted within the same system. The advantage is that the access control system can be operated with security levels and operation times adjusted to different situations. One working example of several operational barrier sections is that a two-bar or boom-like barriers can be used for daily operation to control two roadways—one for incoming traffic and one for outgoing traffic. A sliding gate can be used when there are low traffic or at night time to provide for a higher security level. By using the barriers the opening times are quicker and thus more vehicles can enter in a shorter time.

The barriers offer quick opening/closing times and relatively low security to control access for vehicles and the sliding gate establish a higher security level blocking for both vehicles and persons.

In an embodiment of the access control system the at least two operational barrier sections are interchangeable. The effect is a flexible solution for the operational barriers of the access control system. The advantage of this flexibility is the system can be integrated with a variety of existing perimeter protection of a secured perimeter depending on which order of protection is preferred from within the secured perimeter and outwards to a non-secured area.

In an embodiment at least one operational barrier section comprised in the access control system is a sliding construction configured to extend outwards from the portable container and to securely close and open to block and to allow access through a perimeter protection.

An effect of this embodiment is to provide a high level security barrier section with a portable access system. This is advantageous in regard to up-holding a high security level for an area with a perimeter otherwise secured and still to allow access way to the area. And this by using a system that reduces time and expenses for installation compared to existing systems.

In an embodiment at least one access control system wherein at least one operational barrier section is a boom-like construction configured to be moved out of the portable container and be operated to securely close and open to block and to allow access through a perimeter protection.

An effect of this embodiment is to provide a low level security barrier section with a portable access system. This is advantageous in regard to providing a barrier section to an existing or temporarily established secure perimeter to uphold the secure perimeter with an access way secured by a fast change operational barrier.

An additional effect of the abovementioned embodiments are that the barrier can be operated with container doors closed. The advantage of operating the operational barriers of the access control system with closed container doors is to control access to the inside of the container and thereby providing a secured storage room or control room inside the container.

In an embodiment the access control system further comprises an interface for perimeter security signals with means to connect to a perimeter security signal pathway.

The interface for perimeter security signal may be a transducer, a receiver module, a transmitter module or the like to with a cable or sensor may be connected depending on the security signal pathway used.

The perimeter security signal pathway may be a microphone cable, a light guide or the like and runs along the perimeter otherwise secured by a physical perimeter barrier.

The effect is to interconnect the perimeter protection with the portable access system in regard to signal path way. An advantage is that for a perimeter secured by electrical, optical or other signal ways for trespassing alarm this can be connected with the portable system and thus a closed loop of the signal way can be achieved with the advantage of sustained security and surveillance level of the secure perimeter.

The effect is to interconnect the perimeter protection with the portable access system physically. This is advantageous in regard to that physical gaps in the protection barrier are omitted and thus unintentional access ways are eliminated.

In connection with abovementioned embodiment comprising an interface with means to connect security signals to a perimeter protection a further embodiment of the access control system is one where an end post is comprised in the system and configured to interlock with at least one operational barrier section and connecting to existing perimeter protection. The said end post is portable and can be stored within the portable container when closed. The effect of this embodiment is that an operational barrier of the system can be interlocked with an end post. Thereby achieving the advantage that the operational barrier is interlocked in both ends, one end by a construction in the container and the other by the end post.

Furthermore, if the abovementioned embodiment comprises an already existing perimeter the end post is connected to the existing barrier of the secure perimeter and thus, the access control system act as part of a stationary system while still being portable if the system is moved or the existing perimeter harrier is altered.

Another view of the embodiment is that the effect is to interconnect the existing perimeter protection with the portable access system physically. This is advantageous in regard to that physical gaps in the protection barrier are omitted and thus unintentional access ways are eliminated.

In an embodiment the invention further comprises an interface for perimeter security signals to a perimeter protection, which interface is configured to communicate with a first perimeter protection end and a second perimeter protection end.

The effect is to interconnect the existing perimeter protection with the portable access system in regard to signal path way. An advantage is that for a perimeter secured by electrical, optical or other signal ways for trespassing alarm this can be connected with the portable system and thus a closed loop of the signal way can be achieved with the advantage of sustained security and surveillance level of the secure perimeter.

In an embodiment the invention comprises a portable perimeter protection configured to establish a perimeter protection of the area to be secured In a further embodiment of the invention the portable perimeter protection comprises a first perimeter protection end, a second perimeter protection end and end post configured to interlock with at least one operational barrier section. The portable perimeter protection also comprises a perimeter security signal pathway and the portable perimeter protection is configured to be stored within the portable container during storage and transport.

The portable perimeter protection can be packed to a stored condition to be stored within the portable container. The portable perimeter protection may be in form of a fence, a railing or the like configured to be coiled up or stacked for storage. The portable perimeter protection does not require concrete foundation or other moulded or cast foundations.

The effect of this embodiment is to provide a secure perimeter to an area with an otherwise non-secure perimeter. A non-secure perimeter may encircle an area which is intended to be used either temporarily or on a more long term basis as an area with a secure perimeter. The non-secured area has no existing perimeter protection or perimeter barrier or part thereof. This embodiment thus has the advantage that a secure perimeter with access control system can be established using a single portable system. A further advantage is that a complete secure perimeter protection with controlled access way is established with omission of constructions like concrete foundations. This reduces the installation time due to the construction time for digging holes for the concrete foundations and drying time for the concrete is eliminated.

A further embodiment of the invention is that the portable container comprises a section configured with a personnel gate allowing personnel to pass through the container from one side of a secure perimeter to another side. The effect is that a person entrance is established to and from the secured area. This gives several advantages. One is that an entrance for security or other personnel working within the secure perimeter is provided. Another advantage is that the entrance can work as a control point for guests to enter the area. Also it can work as an emergency exit for fast exit from within the area through the secure perimeter.

Operation of the access control system is accomplished by comprising a control system for barrier operation in the system. The control system for barrier operation is configured to operate at least one operational barrier section. The effect is that the operational barriers can be operated automatically. This is advantageous in regard to that the access control system does not require manual opening and closing of the barrier. The access can be controlled either by personnel at the premises granting access, by using a key-card scanner or by remote control of the control system using IR signals or other communication signals for operation.

In one embodiment of the access control system at least one operational barrier section is a sliding construction mounted inside the container on a telescopic sliding system.

One effect is that the operational barrier section may be used outside the container for perimeter protection in its full length. The advantage is that an increased range in perimeter protection may be achieved without increasing the size of the container.

One example of the advantage of such an embodiment may be that an operational barrier section of 4.3 meters contained in a 20 foot container may have an increased range in perimeter protection of up to say 120 cm compared to not using a telescopic sliding system. This is just one example of an achieved advantage of the embodiment and thus other dimensions may be used and other increments in perimeter protection range may be achieved. Different designs may provide an increased range of say 40 cm, 70 cm, 100 cm, 120 cm or even beyond. The increased range may be adjustable and controllable according to varying needs.

A further advantage of a telescopic system is that the telescopic part of the construction provides a counter weight to the operational barrier section. Such counterweight provides to the overall stability of the container during operation.

In an embodiment the access control system further comprises a mobile technique box configured for comprising one or more electronic units configured for operating at least a part of the access control system.

One effect is that the complete controller system for operation of the operational barrier may be comprised in the mobile technique box. The controller system may include motors for the sliding operating of the operational barrier, controller units or other electronic equipment. This may be advantageous in regard to interchanging a defect controller system with a working controller system simply by plug and play. A further advantage may be that the controller system may be securely locked inside the mobile technique box to prevent non-authorized persons to make alterations on the system.

In a further embodiment of the access control system the mobile technique box is configured with one or more cooling systems. One effect of this embodiment may be the mobile technique box operates as a heat sink for the electronic equipment comprised in the box. This may be advantageous in regard to prolonged lifetime of the electronic units and reduced power consumption due to optimal operation temperatures of the electronic units.

In yet a further embodiment of the access control system the mobile technique box comprises a front plate, which front plate is configured to constitute a door-like barrier into the container, and configured with a front plate opening configured for unhindered sliding passage of an operational barrier section.

The front plate may be placed in the immediate vicinity of a container door on the inside of the container, and thus act as a second layer in the container opening for in this way to act as a second container door when the actual container door is opened. The front plate may be able to interlock with a second adjacent container door.

One effect of this embodiment is that a sliding operation of an operational harrier may be achieved with the container safely locked during operation. The operational barrier may be a slidable construction like a cantilever gate or simply a slidable boom-like barrier, however not limited to these two examples. One advantage of this embodiment is that the access control system may be operated without the risk of intruders within the container during operation, and thus, if the access control system is to be used in unsafe areas, thereby offering a better security for the operational personnel.

In one embodiment of the access control system the portable container is a 20 foot container and wherein one operational barrier section is a sliding construction mountable inside the container on a telescopic sliding system. The reach or extend of the operational barrier outside the container is beyond 4.3 m, beyond 5.0 m, or at least 5.5 m.

One effect is that the operational barrier section may be used outside the container for perimeter protection in its full length. The advantage is that an increased range in perimeter protection may be achieved without increasing the size of the container. The increased range may be adjustable and controllable according to varying needs.

In one embodiment of the access control system the portable container has a length and one operational barrier section is a sliding construction mountable inside the container on a telescopic sliding system. The reach or extend of the operational barrier outside the container is at least the length of the portable container.

One effect is that the operational barrier section may be used outside the container for perimeter protection in its full length. The advantage is that an increased range in perimeter protection may be achieved without increasing the size of the container. The increased range may be adjustable and controllable according to varying needs.

An object of the invention may be achieved by a method of controlling access to an area using an access control system. Such method may comprise acts of placing an access control system comprising a portable container to cover at least one perimeter protection end with a permanent barrier section and with at least one operational barrier section to cover at least another perimeter protection end. Furthermore, the method comprises the act of operating the operational barrier section of the access control system between an open state and a closed state to allow and to block access to area through secure perimeter protection.

One effect of this method is to install and operate the access control system as a protection barrier to an already existing perimeter protection. This method is advantageous in regard to providing a barrier section to a secured perimeter while establish an access way secured by one or more operational barriers. Thus one advantage of this method is to up-hold the secured perimeter while providing an access way.

A further effect of this method is that the access control system contained in and comprised of a portable container is that the system is compressed to a single portable container when not operated. This is advantageous in regard to storage and shipment of complete systems, as storage, handling and transport of the containers can be done by ordinary logistic means.

The previous described effects and related advantages of the portable access control system are also related to the present describe method. Thus, in short the effect of this method is that the portable access control system including all parts of the system is moveable with the advantage that no concrete foundation is required thereby reducing installation time and expenses. Additional effects are that the access control system is a plug-and-play system. This is advantageous not only in regard to installation time and expenses due to constructions but also in reduced resources such as manpower and skilled workers and furthermore, the method provides for a short timeframe wherein installation and a fully operational system are achieved.

Another object of the invention may be achieved by a method of controlling access to an area using an access control system further comprising an act of operating the operational barrier section with a dual level of perimeter security having a high level of perimeter security and a low level of perimeter security.

Yet another object of the invention may be achieved by the method of controlling access to an area using an access control system further comprising an act of operating the operational barrier section with a dual level change speed between open and closed states, the change speed having a slow change and a fast change.

The effects are that different levels of security can be upheld using one access control system and furthermore that the operation time of the operational barrier sections can be adjusted within the same system. The advantage is that the access control system can be operated with security levels and operation times adjusted to different situations.

An object of the invention may be achieved by a method of controlling access to an area using an access control system wherein the act of operating at least one barrier section involves extending the reach of the operational barrier by means of a telescoping sliding system.

One effect of this method is that the operational harrier section may be used outside the container for perimeter protection in its full length. The advantage is that an increased range in perimeter protection may be achieved without increasing the size of the container. A further advantage of a telescopic system is that the telescopic part of the construction provides a counter weight to the operational barrier section. Such counterweight provides to the overall stability of the container during operation.

Another object of the invention may be achieved by a method of controlling access to an area further comprising an act of securing the area by placing portable perimeter protection along a non-secure perimeter of the area.

One effect of this method is to install and operate the access control system as a protection barrier along a non-secure perimeter of an area with the advantage securing an entire area with a perimeter protection. The extend or reach of the protection harrier may be adjustable and controllable according to varying needs.

Due to the portable character of the system the method provides the further advantage that an entire area can be provided with a temporary perimeter protection. And with a perimeter protection which still provides an access way in and out of the secured area.

The previous described effects and related advantages of the portable access control system and method hereof also relates to the present described method. Thus, in short the effect of this method is that the portable access control system including all parts of the system is moveable with the advantage that no concrete foundation is required thereby reducing installation time and expenses. Additional effects are that the access control system is a plug-and-play system. This is advantageous not only in regard to installation time and expenses due to constructions but also in reduced resources such as manpower and skilled workers and furthermore, the method provides for a short timeframe wherein installation and a fully operational system are achieved.

An object of the invention may be achieved by a method of controlling access to an area secured by existing perimeter protection. Such method may comprise acts of identifying a first perimeter protection end and a second perimeter protection end between which ends there is access through an otherwise secure perimeter, and of placing an access control system comprising a portable container to cover at least one perimeter protection end with a permanent harrier section and with at least one operational barrier section to cover at least another perimeter protection end. Furthermore the method comprises the act of operating the operational barrier section of the access control system between an open state and a closed state to allow and to block access to the area through secure perimeter protection. The effect of this method is to install and operate the access control system as a protection barrier with an existing perimeter barrier. The advantage is to sustain a secured perimeter with a portable system and at the same time ensuring ways to access the secured perimeter.

One example of the act of identifying a first perimeter protection end and a second perimeter protection end requires mapping out the otherwise secured perimeter by existing perimeter protection. Thereby identifying and localizing the positions of the perimeter protection ends and thus, the passage between the perimeter protection ends are where the access control system is to be placed. The portable container is placed on either side of the perimeter protection covering the first perimeter protection end with the end of the container arranged not to be opened. Thus, the container end opposite to that end of the container arranged for the operational barriers to be placed. The portable container can be placed either on the inside or on the outside of secured perimeter. Existing perimeter protection can comprise a fence, a railing, a wall, a kind of build construction, a combination of these or the like. The existing perimeter protection is not part of the access control system. Thus security level and state of the existing perimeter protection are not covered by this invention. By placing the portable container to cover the first perimeter protection end, the portable container thereby elongates the existing perimeter protection working as permanent harrier section of the access control system. At the second perimeter protection end an end post is placed on either side of the perimeter protection covering the second perimeter protection end. Thereby leaving open a passage way between the end post and the container-end, which container end can be opened and closed and from which end the operational barriers are operated. This passage way is where the operational barriers are positioned and operated between an open state and a closed state to allow and to block access to the perimeter.

One embodiment is to establish an access control system for vehicles and people, which is quick to install, move, dismantle and has low installation cost. One of the benefits is to eliminate the concrete and fixed installation to the ground, which is normal for this type of equipment. Another benefit is the mobility of the system as it is mounted in a container which is easy to move and transport. This reduce installation time and cost. The system is easy to move and store as it is mounted in a normal standard container.

Another object of the invention may be achieved by a method of securing and controlling access to an area with a non-secure perimeter. Such method may comprise acts of identifying the non-secure perimeter to be secured and placing an access control system comprising a portable container at the non-secure perimeter or bordering on the non-secure perimeter and placed in a way that permanent barrier section and operational harrier section in continuation constitute part of a protection barrier for the area to be secured. Also comprised in the method is the act of placing a portable perimeter protection along the non-secure perimeter. Furthermore the method comprises the act of operating the operational barrier section of the access control system between an open state and a closed state to allow and to block access to the area (19) through secure perimeter protection.

The effect of this method is to install and operate the access control system as a protection barrier without an existing perimeter barrier by further providing a portable perimeter protection. The advantage is that a non-secure perimeter is secured using a single portable system and at the same time ensuring ways to access through the now secure perimeter. Further advantages according to abovementioned are also found for this object of the invention.

DESCRIPTION OF THE DRAWING

FIG. 1A illustrates an area with a perimeter protection at the perimeter, FIG. 1B illustrates a perimeter protection with an open barrier section, and FIG. 1C illustrates a perimeter secured by a perimeter barrier and an access control system in a portable container.

FIG. 2A illustrates a layout of portable container with at least one operational barrier section; FIG. 2B illustrates the closed container comprising and containing the access control system.

FIG. 3 illustrates embodiments of operational barrier sections in open and closed state; A) a slidable barrier (cantilever gate) and B) a bar or boom-like barrier.

FIG. 5A illustrates an embodiment with access control section in the container, FIG. 5B illustrates an embodiment with remote access control section and figure SC illustrates a layout of portable container with a high level security operational barrier section and a portable perimeter protection. FIG. 5C further illustrates interface for perimeter security signals.

FIG. 6 illustrates an embodiment with access control system for a non-secure perimeter. The non-secure perimeter and the portable container containing the access control system are illustrated in FIG. 6A. FIG. 6B illustrates an embodiment with access control system utilising portable perimeter protection for a secure perimeter.

FIG. 8 illustrates a telescopic sliding system for sliding operation of an operational barrier section.

FIG. 9 illustrates a mobile technique box.

DETAILED DESCRIPTION OF THE INVENTION

Reference Term

Figure 4:
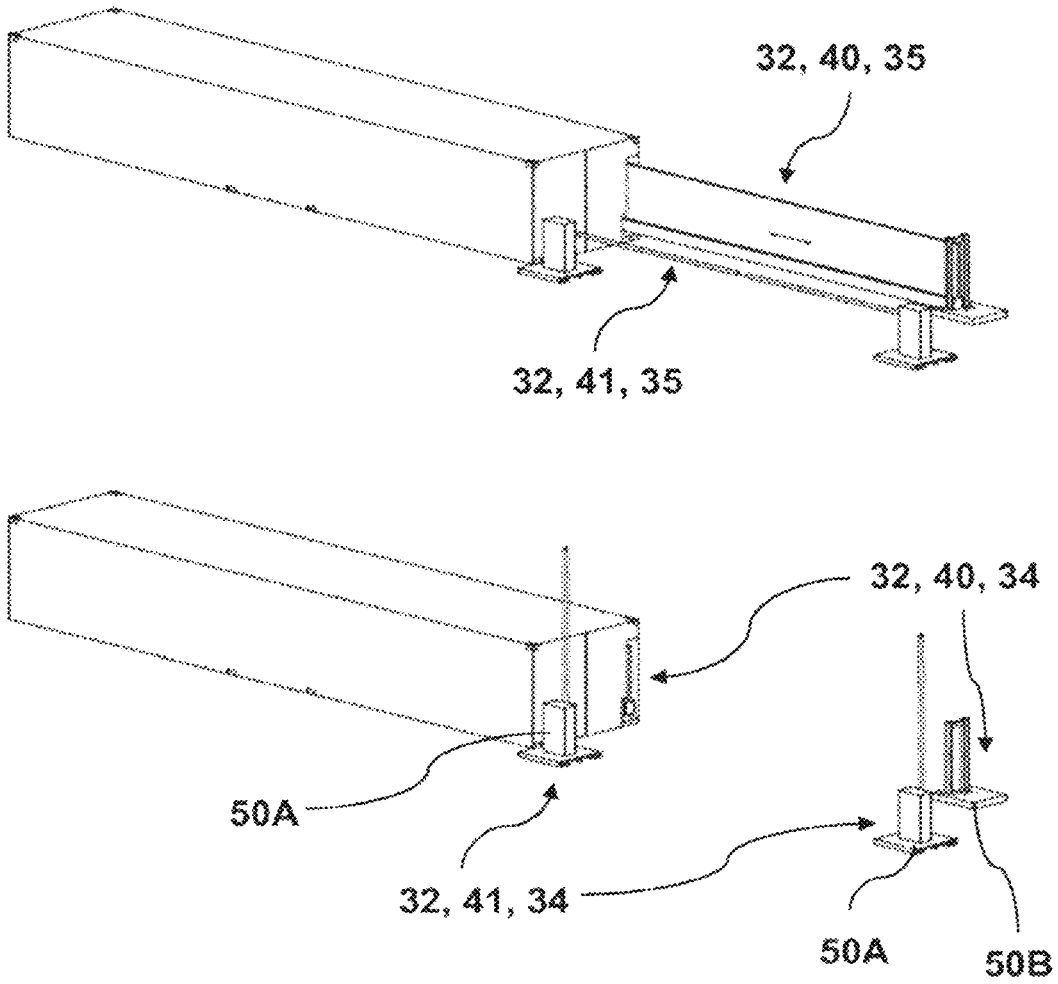
FIG. 4 illustrates an embodiment with multiple barrier sections operable from the same container. The embodiment is shown in open and closed state.

10 Access control system
11 Non-secure perimeter
12 Perimeter
13 Secure perimeter
14 Perimeter protection/barrier
15 First perimeter protection end
16 Second perimeter protection end
18 Portable perimeter protection
19 Area
20 Portable container
22 Closed container
24 Open container
26 Container door
28 Door-like barrier
30 Barrier section
31 Permanent barrier section
32 Operational barrier section
34 Open state
35 Closed state
36 Sliding construction
40 high level of perimeter security
41 low level of perimeter security
42 Fast change -continued

| DETAILED DESCRIPTION OF THE INVENTION Reference Term |
|---|
| 43 Slow change |
| 50 End post |
| 60 Interface for perimeter security signals |
| 62 Perimeter security signal pathway |
| 70 Personnel gate |
| 80 Control system for barrier operation |
| 90 Mobile technique box |
| 92 Mobile technique box front plate |
| 94 Front plate opening |
| 98 Cooling system |
| 100 Electronic unit |
| 102 Motor |
| 110 Telescopic sliding system |
| 112 Mounting bracket |
| 114 Mounting hinges |

FIG. 1 illustrates an area 19 with a perimeter protection 14 at the perimeter 12. In FIG. 1A an intact perimeter harrier 14 is shown encircling the area 19 to be secured by a secure perimeter 13. FIG. 1B illustrates a perimeter 12 with a perimeter protection 14, which perimeter protection 14 has an open barrier section giving access to the area 19 through the perimeter protection 14. Thus figured 1B illustrates a non-secure perimeter 11. In FIG. 1C is illustrated a perimeter 12 secured by a perimeter barrier 14, of which perimeter barrier an access control system 10 in a portable container 20 constitute a barrier section 30. The access control system 10 is illustrated with a permanent barrier section 31 and an operational barrier section 32. Here the wall of the portable container 20 constitutes the permanent barrier section 31. In FIG. 1C the perimeter 12 is a secure perimeter 13

FIG. 2A illustrate layouts of the portable container 20 with at least one operational barrier section 32 contained within the portable container 20. The container is illustrated in a open 24 and closed 22 state and with the container doors 26 illustrated as dotted lines. FIG. 2B illustrates the closed container 22 configured to be stored, transported and installed. The closed container 22 comprises and contains the access control system 10. The container itself comprises a permanent barrier section 30 to cover at least one perimeter protection end 15, 16. The container is illustrated to comprise operational barrier sections 32 one providing a high level of perimeter security 40 and one providing a low level of perimeter security 41. The operational harrier section 32 providing a high level of perimeter security 40 may be motorized or electrically operated in other ways and thus the portable container 20 may further comprise electronic units 100 or motors 102.

FIG. 3 illustrate embodiments of operational barrier sections 32 in open 34 and closed 35 state. FIG. 3A illustrates a slidable barrier (cantilever gate) providing a high level security operational harrier 40 with an end post 50B for interlocking the barrier section; and FIG. 3B illustrates a bar or boom-like barrier for low level perimeter security 41. Here the end posts 50A comprises the base of the bar or boom-like barrier.

FIG. 3A also illustrates that the portable container may have a slit in a section. The slit may have a complimentary shape to the operational barrier 40 so that the operational barrier can pass through the slit and maintain the interior of the portable container secured or weather sealed whilst in operation. In the shown embodiment, the slit is made in a door 26 at the end of the portable container. In some embodiments of the present disclosure, the section comprising the slit is configured for interlocking with an adjacent portable container door.

FIG. 4 illustrates an embodiment with multiple barrier sections operable from the one portable container 20. The embodiment is shown in open 34 and closed state 35. The embodiment illustrates a high level security operational barrier 40 and a low level security harrier 41. The operational barriers cover at least one perimeter protection end 15, 16 and the end posts 50 of the operational barriers are portable.

FIG. 5A illustrates an embodiment with control system for barrier operation 80 placed inside the portable container 20 and configured to be operated from inside the container. FIG. 5B illustrates an embodiment with control system for barrier operation 80 placed inside the container 20 configured to be remote operated from outside or inside the container. FIG. 5C illustrates a layout of portable container with a high level security 40 operational barrier section 32 and a portable perimeter protection 18. The portable perimeter protection is illustrated in stored conditions. FIG. 5C further illustrates interface for perimeter security signals 60 and the hereto connected perimeter security signal pathway 62.

FIG. 6 illustrates an embodiment with access control system 10 for a non-secure perimeter 11. The non-secure perimeter 11 and the portable container 20 containing the access control system are illustrated in FIG. 6A. FIG. 6B illustrates an embodiment with access control system 10 utilising portable perimeter protection 18 to obtain a secure perimeter 13.

Figure 7:
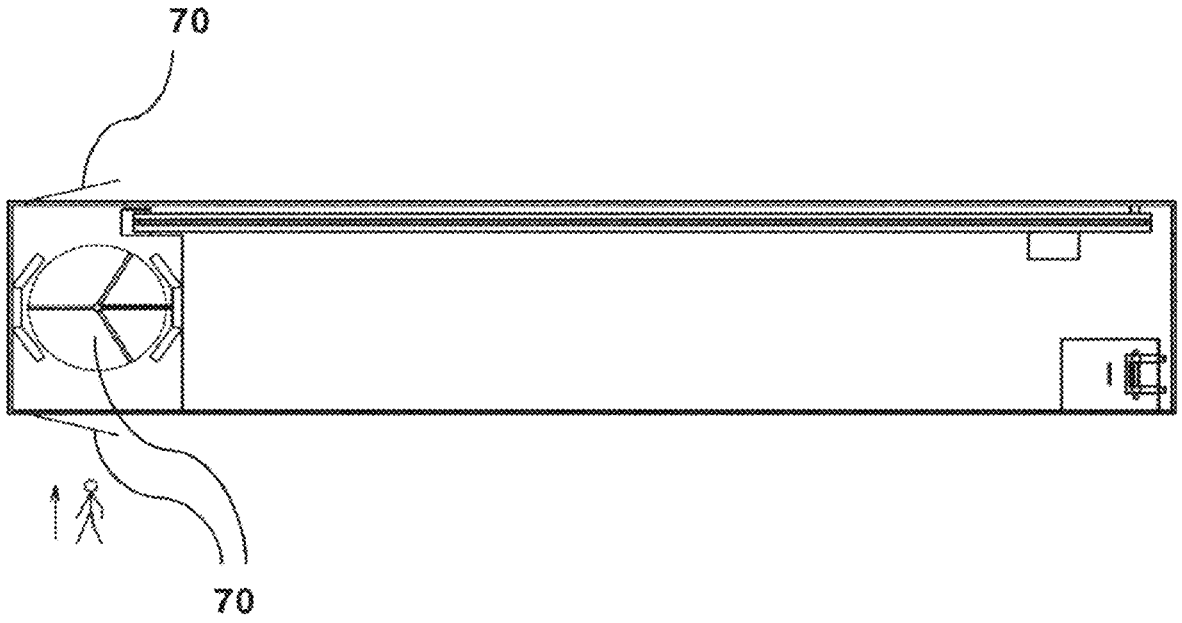
FIG. 7 illustrates an embodiment with container section for personal access.

FIG. 7 illustrates an embodiment with a container section configured for personal access through a personnel gate 70 allowing personnel to pass through the container 20 from one side of a secure perimeter to another side.

FIG. 8 illustrates an embodiment of a telescopic sliding system 110 for sliding operation of an operational barrier section 32. FIG. 8A illustrates the embodiment from in front view. A side view of the embodiment is illustrated in FIG. 8B and a top view in FIG. 8C. The operational barrier section 32 is a sliding construction 36. The telescopic sliding system 110 is mounted on a mounting bracket 112. The mounting bracket 112 is mounted with mounting hinges 114, which hinges 114 may be mounted inside the container onto the container side. The mounting bracket 112 illustrated in this embodiment comprises a part onto which the operational barrier section 32 may slide via a wheel or castor construction. Thus, in this embodiment the operational barrier section 32 is connected to the mounting bracket 112 in the top and in the bottom through a wheel or castor construction in the top and a telescopic sliding system 110 in the bottom part.

FIG. 9 illustrates one embodiment of a mobile technique box 90. A perspective view of the embodiment is illustrated in FIG. 9A. FIG. 9B illustrates a top view and a side view of the front plate 92 is illustrated in FIG. 9C.

The mobile technique box 90 may comprise electronic units 100 for operating the operational barrier section. This may include a motor 102 in case the sliding operation of the operational harrier section 32 is motorized. The electronic units 100 may also include logic controllers, transformers or other electronic modules. Furthermore, the mobile technique box 90 may include a cooling system 98 as illustrated in this embodiment. The cooling system may act as a heat sink for the electronic units for optimized operating temperature and consequently increased lifetime of the electronic units 100.

The mobile technique box 90 may comprise a front plate 94 configured with a front plate opening 94. In the illustrated embodiment the front plate 94 extends sideways out from the box to one side. The front plate 94 may act as a door-like barrier into the container 20 and thus the dimensions of the front plate 94 may be comparable to a container door. The front plate may on one of the sides (right of left hand side) comprise means for interlocking with an adjacent container door and on the other three sides (top, bottom and left or right hand side) comprise means for interlocking with the walls of the container and thereby achieving that the front plate 92 acts as a door-like barrier 28 into the container 20. The front plate 92 may comprise an opening 94 through which, the operational harrier section 32 working as a sliding construction 36 may pass unhindered during operation.

Figure 10:
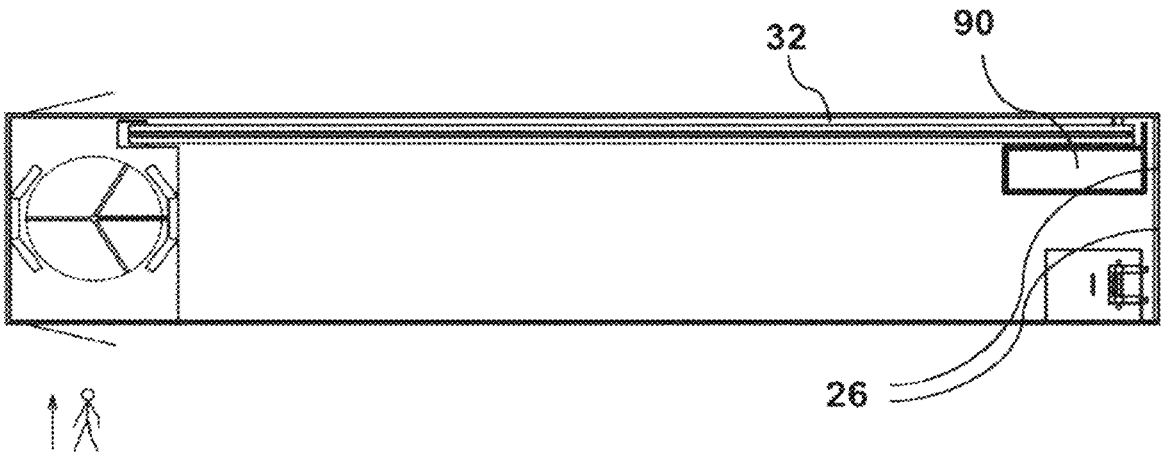
FIG. 10 illustrates an embodiment with container section for personal access (FIG. 7) with a mobile technique box installed.

FIG. 10 illustrates an embodiment with container section for personal access as previously described for the embodiment illustrated in FIG. 7. The embodiment illustrated in here in FIG. 10 further comprises a mobile technique box 90 installed in the container 20. The box 90 is installed in that end of the container through which the operational barrier is operated. The box is placed such that the front plate 92 is adjacent to one container door 26 such that the opening 94 is placed between the operational barrier section 32 and the container door 26.

What is claimed is:

1. An access control system for controlling access to an area secured by a perimeter protection defining a secure perimeter, the access control system comprising:

a portable container configured and arranged to be stored, transported, installed and operated to secure a perimeter using an operational barrier section, which is fully contained within the closed container;

said operational barrier section is a sliding construction configured and arranged to operate in an open state to allow access through the secure perimeter to the area, wherein the operational barrier section is fully contained within the closed portable container, a closed state extended outwards from the portable container, wherein the operational barrier section blocks access to the area secured by the perimeter, and transition between the open state and the closed state; and wherein the portable container comprises a slit in a section, said slit being configured and arranged for the operational barrier to operate through, such that the portable container is sealed off whilst the access control system is in operation including operation in the open state, the closed state and the transition between the open and closed state.

2. The access control system according to claim 1, wherein the slit has a complimentary shape to the operational barrier, such that the operational barrier can pass through the slit and maintain the interior of the portable container secured or weather sealed whilst in operation.

3. The access control system according to claim 1, wherein the section comprising the slit, is a door at one end of the portable container.

4. The access control system according to claim 1, wherein the section comprising the slit is configured for interlocking with an adjacent portable container door.

5. The access control system according to claim 1, further comprising a mobile technique box in the portable container, said mobile technique box includes an enclosed housing that is formed by a plurality of side walls, one of said plurality of side walls extending outwardly of said enclosed housing to provide a front plate, said front plate comprising the slit configured for the operational barrier to operate through and comprising means on said front plate configured for interlocking with an adjacent portable container door.

6. The access control system according to claim 1, comprising an additional operational barrier section being a boom-like construction configured to be moved out of the portable container and operate to securely close and open to block and to allow access through the secure perimeter.

7. The access control system according to claim 1, further comprising an end post configured to interlock with at least one operational barrier section and connect to the perimeter protection, which end post is portable and can be stored within the portable container, when said portable container is closed.

8. The access control system according to claim 1, further comprising an interface for perimeter security signals with means to connect to a perimeter security signal pathway.

9. The access control system according to claim 1, further comprising an interface for perimeter security signals to a perimeter protection, which interface is configured to communicate with a first perimeter protection end and a second perimeter protection end.

10. The access control system according to claim 1, comprising a portable perimeter protection which is configured to establish a perimeter protection of the area to be secured.

11. The access control system according to claim 10, wherein the portable perimeter protection comprises a first perimeter protection end, a second perimeter protection end, end post configured to interlock with at least one operational barrier section, and a perimeter security signal pathway which is configured to be stored within the portable container during storage and transport.

12. The access control system according to claim 1, further comprising a section of the portable container configured with a personnel gate allowing personnel to pass through the container from one side of a secure perimeter to another side.

13. The access control system according to claim 1, further comprising a control system for barrier operation configured to operate the at least one operational barrier section.

14. The access control system according to claim 1, wherein the at least one operational barrier section is a sliding construction mountable inside the container on a telescopic sliding system.

15. The access control system according to claim 5, wherein the mobile technique box comprises one or more electronic units configured for operating at least one operational barrier section of the access control system.

16. The access control system according to claim 5, wherein the mobile technique box is configured with one or more cooling systems.

17. The access control system according to claim 5, wherein the mobile technique box comprises the front plate constituting a door-like barrier into the container.

18. The access control system according to claim 1, wherein the portable container is a 20 foot container and wherein the operational barrier section is a sliding construction mountable inside the container on a telescopic sliding system, and wherein the reach or extend of the at least one operational barrier outside the container is beyond at least 4.3 m.

19. The access control system according to claim 1, wherein the portable container has a length and the at least one operational barrier section is a sliding construction mountable inside the container on a telescopic sliding system, and wherein the reach of the at least one operational barrier outside the container is at least the length of the portable container.

20. The mobile technique box according to claim 5, including a motor inside the enclosed housing for driving a telescopic sliding means of the operational barrier assembly in the portable container.

21. The mobile technique box according to claim 5, including an electronic control unit inside the enclosed housing for operating the operational barrier assembly in the portable container.

22. The mobile technique box according to claim 5, including a cooling system inside the enclosed housing.

23. A method of controlling access to an area secured by existing perimeter protection, the method comprising the steps of:

identifying a first perimeter protection end and a second perimeter protection end between which ends there is access through an otherwise secure perimeter to area, placing an access control system according to claim 1, to cover at least one perimeter protection end with the portable container and with at least one operational barrier section to cover at least another perimeter protection end, and operating the at least one operational barrier section of the access control system between an open state and a closed state to allow and to block access to area through secure perimeter protection.

24. A method of securing and controlling access to an area with non-secure perimeter; the method comprising the steps of:

identifying a non-secure perimeter to be secured:

placing an access control system according to claim 1 on the non-secure perimeter or bordering the non-secure perimeter and placed in a way such that the portable container and the operational barrier section in continuation constitute part of a protection barrier for the area to be secured;

placing a portable perimeter protection along a non-secure perimeter, and operating the operational barrier section of the access control system between an open state and a closed state to allow and to block access to area through secure perimeter protection.

25. A method of controlling access to an area using the access control system of claim 1, the method comprising a portable container configured as a permanent barrier section and at least one operational barrier, the method comprising the steps of:

placing the access control system to cover at least one perimeter protection end with said portable container and at least one operational barrier to cover another perimeter protection end; and operating at least one operational barrier section of the access control system between an open state and a closed state to allow and to block access, respectively, to the area through secure perimeter protection.

26. The method according to claim 25, further comprising steps of operating the at least one operational barrier section with a dual level of perimeter security having a high level of perimeter security and a low level of perimeter security.

27. The method according to claim 25, further comprising steps of operating the at least one operational barrier section with a dual level change speed between open and closed states, the change speed having a slow change and a fast change.

28. The method according to claim 25, wherein the step of operating at least one barrier section involves extending the reach of the at least one operational barrier by means of a telescoping sliding system.

29. The method according to claim 25, further comprising a step of securing the area by placing portable perimeter protection along a non-secure perimeter of the area.

30. A mobile technique box for use with the portable container of the access control system of claim 1, said mobile technique box comprising:

an enclosed housing that is formed by a plurality of side walls, one of said plurality of side walls extending outwardly of said enclosed housing to provide a front plate, said front plate defining a slit through which a barrier means from within the portable container can be moved, and means on said front plate for interlocking with an adjacent portable container door.

31. The mobile technique box according to claim 30, including a motor inside the enclosed housing for driving a telescopic sliding means of an operational barrier assembly in the portable container.

32. The mobile technique box according to claim 30, including an electronic control unit inside the enclosed housing for operating an operational barrier assembly in the portable container.

33. The mobile technique box according to claim 30, including a cooling system inside the enclosed housing.

34. An operational barrier assembly for use with the portable container of the access control system of claim 1, said operational barrier assembly comprising:

a mobile technique box including an enclosed housing that is formed by a plurality of side walls, one of said plurality of side walls extending outwardly of said enclosed housing to provide a front plate, said front plate defining a slit through which a barrier means from within the portable container can be moved, and means on said front plate for interlocking with an adjacent portable container door;

a mounting bracket for placement inside the portable container and attachment to a side wall of the portable container;

a barrier member; and a telescopic sliding means for moving the barrier member relative to the mounting bracket and the side wall of the portable container.

35. The operational barrier assembly according to claim 34, wherein said mounting bracket includes a horizontally-oriented beam member for guiding the telescopic sliding means.

* * * * *